US007191817B2

(12) United States Patent
Nicolosi

(10) Patent No.: US 7,191,817 B2
(45) Date of Patent: Mar. 20, 2007

(54) SIMPLIFIED DEVICE FOR MAGNETICALLY OPERATING BLINDS WITHIN A GLASS-ENCLOSED CHAMBER

(75) Inventor: Giovanni Nicolosi, Dresano-Milano (IT)

(73) Assignee: Pellini S.p.A., Codogno (IT)

( * ) Notice: Subject to any disclaimer, the term of this patent is extended or adjusted under 35 U.S.C. 154(b) by 0 days.

(21) Appl. No.: 10/513,536

(22) PCT Filed: Jul. 8, 2002

(86) PCT No.: PCT/IT02/00445

§ 371 (c)(1),
(2), (4) Date: Nov. 5, 2004

(87) PCT Pub. No.: WO04/001175

PCT Pub. Date: Dec. 31, 2003

(65) Prior Publication Data

US 2005/0173077 A1 Aug. 11, 2005

(30) Foreign Application Priority Data

Jun. 19, 2002 (IT) ..... MI2002A1351

(51) Int. Cl.
*A47H 5/00* (2006.01)

(52) U.S. Cl. ..... 160/84.06; 160/107

(58) Field of Classification Search ..... 160/90, 160/107, 98, 84.04, 84.05, 84.06, 84.02, 160/279

See application file for complete search history.

(56) References Cited

U.S. PATENT DOCUMENTS

| | | | | |
|---|---|---|---|---|
| 3,129,471 | A * | 4/1964 | Johnson et al. | 49/64 |
| 3,253,644 | A * | 5/1966 | Gotoh et al. | 160/107 |
| 4,508,154 | A * | 4/1985 | Wheeler | 160/98 |
| 4,557,309 | A * | 12/1985 | Judkins | 160/84.06 |
| 4,679,610 | A * | 7/1987 | Spraggins | 160/107 |
| 4,762,159 | A * | 8/1988 | Ford | 160/84.06 |
| 4,817,698 | A | 4/1989 | Rossini et al. | |
| 5,178,200 | A * | 1/1993 | Hagen | 160/107 |
| 5,771,952 | A * | 6/1998 | Gabriel | 160/98 |
| 6,328,090 | B1 * | 12/2001 | Anderson et al. | 160/84.05 |
| 6,354,354 | B1 * | 3/2002 | Schmidt | 160/98 |
| 6,550,520 | B1 * | 4/2003 | Rossini et al. | 160/107 |
| 6,601,633 | B2 * | 8/2003 | Sun et al. | 160/107 |
| 6,929,049 | B2 * | 8/2005 | Nicolosi | 160/107 |
| 6,932,139 | B2 * | 8/2005 | Early et al. | 160/107 |

FOREIGN PATENT DOCUMENTS

| | | |
|---|---|---|
| EP | 0 558 154 A2 | 9/1993 |
| FR | 1 313 315 | 12/1962 |
| FR | 1 405 364 | 7/1965 |
| FR | 2 659 109 | 9/1991 |
| WO | 90/15914 | 12/1990 |

* cited by examiner

*Primary Examiner*—David Purol
(74) *Attorney, Agent, or Firm*—Michael J. Striker

(57) ABSTRACT

System for operating a blind in a glass-enclosed chamber the ends of said blind being respectively fitted to a fixed upper box (40) and to a movable box (60), subjected both to a guide device for translation, parallel to itself, when opening and closing said blind by a pair of cords (85, 86) interacting between the fixed (40) and movable (60) boxes and a lower fixed box (50), and also to a pulling device comprising a small box containing permanent magnets fixed to the movable box (60) and a free knob, containing permanent magnets of opposing pole, so that by matching, through a pane of glass, the magnets in said knob with those fixed to the movable box (60), the blind can be opened or closed as desired.

17 Claims, 5 Drawing Sheets

FIG.5
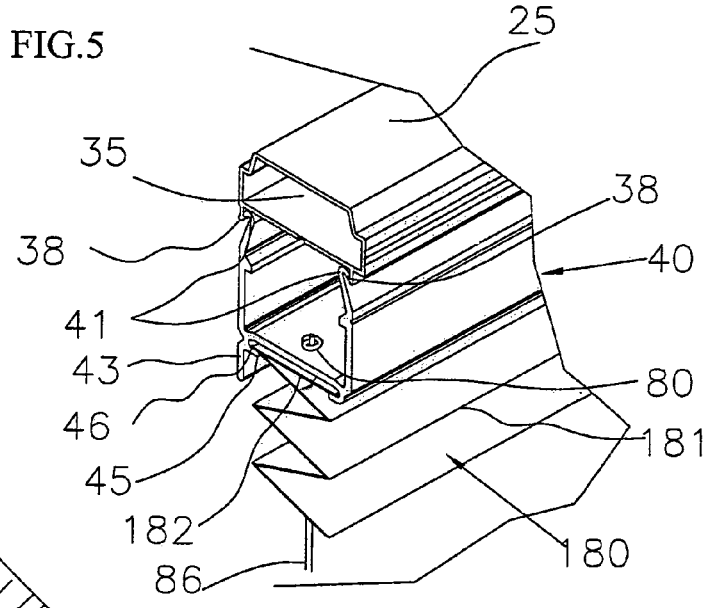
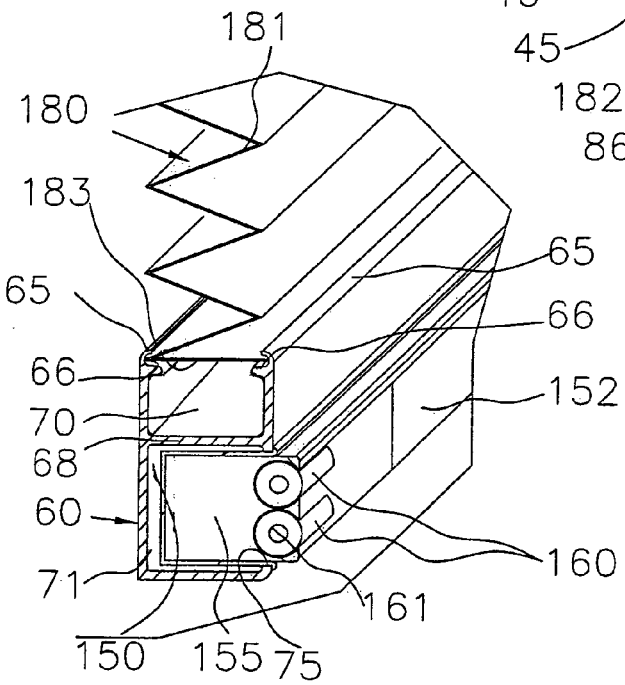
FIG.6
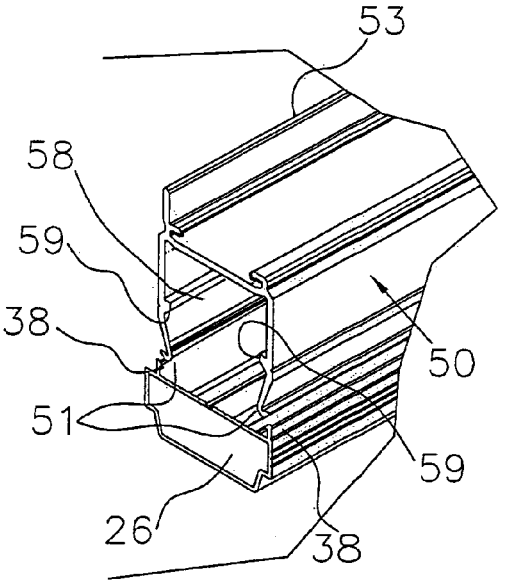
FIG.8
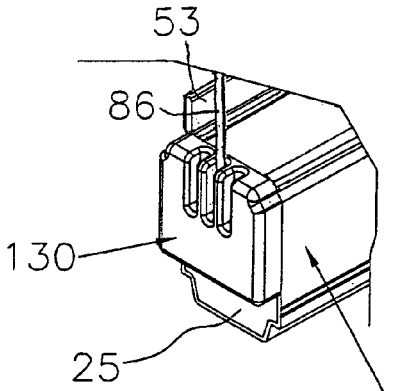
FIG.7

SIMPLIFIED DEVICE FOR MAGNETICALLY OPERATING BLINDS WITHIN A GLASS-ENCLOSED CHAMBER

BACKGROUND OF THE INVENTION

The invention concerns devices for operating blinds placed inside a glass-enclosed chamber.

It is a well-known fact that much heat is lost from within residential buildings through the glass panes of windows and french windows but that such dispersion can be greatly reduced by fitting double glazing with a hermetically sealed chamber between the panes.

The presence of a blind, including the venetian or pleated types, inside the glass-enclosed chamber leads to complications because of the need to work it from outside without interfering with the hermetic seal.

Various operating systems have been devised and applied connecting interrnal and external kinematic mechanisms by lines of magnetic forces acting through one of the panes.

Such devices are however substantially complex and costly.

The chief complications concern the need to ensure that, when moving, the various parts of the blind remain parallel one to another. Use of an internal electric motor greatly increases costs because of the need for reduction mechanisms.

Purely mechanical controls from outside, such as cords, create problems due to the tendency to slippage between internal and external mechanisms connected by magnetic forces.

SUMMARY OF THE INVENTION

The above invention avoids these drawbacks ensuring smooth internal and external movements of the blind by magnetic connections adopting an ingeneous solution consisting of simple and inexpensive means as will now be explained.

Subject of the invention is a system for operating a blind inside a glass-enclosed chamber comprising two panes, a frame formed of four sections, one upper and one lower, and two side sections, all held together by four pieces, one at each corner.

One immovable end of the blind is mounted onto afixed box, here called the upper box, fixed to the upper part of the frame, while the other end of the blind is fixed to a movable box, moved by a device acting through one pane of glass and controlled by a device for guiding translation of said mobile box, parallel to itself, in the operations of opening and closing the blind whatever the spatial position of the glass chamber may be.

The device for moving the movable box comprises two means, acting as a pair, for creating magnetic attraction.

The first means is fixed to the movable box, while the second consists of a free knob.

By making said knob match with the means fixed to the movable box and moving it by hand, the blind can be opened and closed as desired.

The means fixed to the movable box consists of a small parallelepiped box, inserted longitudinally at the centre of said movable box, inside which is a cage containing one or more permanent magnets, placed side by side longitudinally between two sets of freely moving rollers with longitudinal pins.

The rollers project slightly from the geometrical plane that passes through the external surface of said permanent magnets, and from the front of the movable box so that the first means can slide more easily over the glass.

There are preferably two rollers, parallel, in each set, their surface arching slightly to make brief contact with the glass.

The knob forming the second means, is substantially parallepiped in shape and houses one or more permanent magnets placed longitudinally side by side, their pole being opposite to that of the permanent magnets in the first means, said magnets being covered by a thin coating of material such as teflon, velcro and the like so that they can slide more easily over the glass.

Thin metal plates are applied to the bottom of the first means and of the knob for holding the magnets.

The guiding device consists of a pair of interacting cords.

The first cord, fixed close to a first end of the fixed box, extends, even through the blind, as far as the movable box, passes below a first internal crosswise roller, turning close to the first end of said movable box, extends as far as the second end of this latter, passes over a second crosswise terminal roller and is then fixed to the second end of a box, here called the lower box, mounted on the lower section of the frame.

The second cord, fixed close to the second end of the fixed box, extends, even through the blind, as far as the movable box, passes under a third internal crosswise roller, turning close to the second end of said movable box, extends as far as the first end of said movable box, passes round a fourth terminal crosswise roller and is fixed to the first end of the lower box.

In this way, movement of the movable box to open or close the blind, simultaneously produces a variation in length of the first sections of the two cords that connect said movable box to the fixed box, and variation in length, equal and different, of the second sections of said cords connecting said movable box to the fixed box.

The mobile box therefore moves parallel to itself.

If the blinds are wide, a second pair of cords is fitted to the fixed box. The lengths that connect said second pair of cords to the movable box are placed intermediately in relation to the lengths of the first pair of cords, and are guided by other intermediate rollers.

The lengths that connect said second pair of cords to the lower fixed box are guided by the same rollers, at the ends of said movable box, that serve to guide the first pair of cords.

The ends of the cords are fixed one to each end of the lower fixed box by elastic parts that automatically adjust variations in length caused by thermal and mechanical stresses.

The elastic parts are advantageously helical springs mounted on heads fixed to the ends of the lower box and having grooves in which the cords can pass.

One end of each cord passes inside said springs and is fixed to their end.

The four parts of the frame are tubular, the tube having a constant cross section.

The side of said tubes, facing towards the inside of the frame, is flat. At each end of each corner piece are extensions with elastic teeth to press inside the ends of the tubular parts.

Shape of the cross section of the upper and lower fixed boxes is that of a squared "U", the flat side facing towards the tubular sections of the frame.

The ends of the straight sides of said "U" are bent hookwise facing the opposite way, while at the two longitudinal ends of the flat side of tubular parts of the frame are hooks facing towards each other.

Sizes and positions of these hooks are such as to permit the fixed upper and lower boxes to be mounted onto the tubular sections of the frame by pressing the hooks on the boxes into those on said tubular sections.

Shape of the constant cross section of the movable box is substantially that of a squared "U" comprising a crosswise diaphragm forming an internal groove and also a squared "U"-shaped channel open towards the blind.

Light-shading tabs are mounted on the internally-facing edges of the flat sides of the frame's side sections.

Light-shading tabs are also mounted on the edge, corresponding to the outside of the glass-enclosed chamber, of the fixed boxes' flat side.

The rollers inside the movable box, around which the guide cords pass, are preferably supported by internal heads fitted inside the channel open towards the upper fixed box.

The terminal rollers are supported by heads applied to the ends of said movable box by tongues in both the open channel and the internal channel.

The cords pass inside grooves made for them in all the heads referred to above.

In one type of execution the blind is pleated. Where this is so, on its flat back facing the blind, the upper fixed box presents a pair of ribs forming a pair of opposing channels.

Similarly, at the ends of the open channel, the movable box presents a pair of ribs forming a pair of opposing channels.

In this way the two ends of the pleated blind can be fitted into said pairs of opposing channels of both the upper fixed box and of the movable box.

The blind can be a roller blind, a venetian blind, or of any other kind. The invention offers evident advantages.

By associating the pulling device with the guiding device the blind can be opened or closed through one pane of the glass-enclosed chamber, this being done by means that are at once inexpensive, safe and easy to operate.

The guiding device solves a universal problem of translating a mechanical device parallel to itself.

As translation is done using cords, these can be pulled at a distance so that there is no limit to the size of the object to translate, in this case a blind.

The cords do not need straight guides and provide a valid substitute for present mechanical parallelogramic systems that are both complex and bulky.

The parallel translation described makes possible adoption of an extremely simple and safe pulling device limited exclusively to its use at practically any point on the movable box to which the blind is fixed, avoiding all the complications created by presently used devices for pulling and guiding.

By means of the magnetic connection, manual action can be applied directly to the blind while preserving the hermeticity of the glass-enclosed chamber.

The invention described provides an inexpensive, simple and reliable glass-enclosed chamber certain to become popular with users.

Characteristics and purposes of the disclosure will be made still clearer by the following examples of its execution illustrated by diagrammatically drawn figures.

BRIEF DESCRIPTION OF THE DRAWINGS

FIG. 5 Detail of the upper fixed box for the blind, perspective.

FIG. 6 Detail of the movable box at the position of the small magnetic box, perspective.

FIG. 7 Detail of the end of the fixed lower blind-guiding box, perspective.

FIG. 8 Structural details of the fixed lower blind-guiding box and of the lower section of the frame.

DESCRIPTION OF THE EMBODIMENTS

Figure 1:
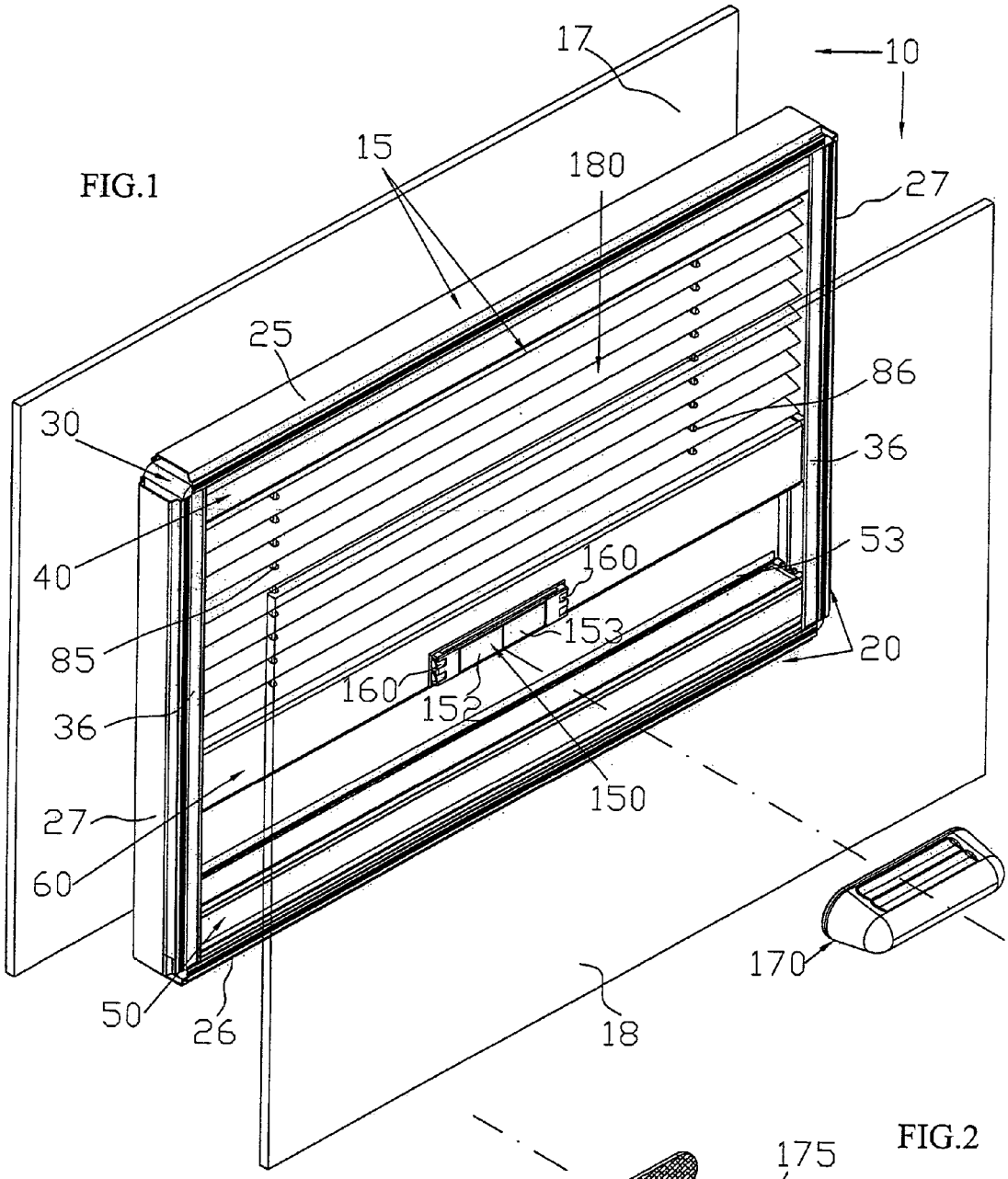
FIG. 1 Structure of the glass-enclosed chamber with frame, a blind guided by a double-cord system, fixed upper box and movable lower box for the blind with small magnetic box, fixed lower blind-guiding box and knob, perspective.

The glass-enclosed chamber 10 comprises the structure 15 and the glass panes 17, 18.

The structure 15 consists of a frame 20 composed of tubular sections, upper 25, lower 26 and lateral sections 27, held together by corner pieces 30.

The tubular sections 25–27 present a cross-cut formed of association of a trapezoidal top and a rectangular base.

Each corner piece 30 comprises terminal heads 32 with lower elastically-toothed inwardly-inclined extensions 33, and the corner joint 31.

The cross-cut of said heads 32 correponds to that of the trapezoidal top of the tubular section while the lower extension with inclined teeth corresponds to the rectangular base of said cross-cut of the tubular sections.

The four sections 25–27 and the corner pieces 30 are put together by pressing the heads 32 of these latter into the ends of the sections. The stresses set up by the inclined teeth of the extension 33 are sufficient to hold the structure firm.

The structure 15 of the glass-enclosed chamber 10 comprises the upper 40 and lower 50 fixed boxes having U-shaped cross-cuts, their ends being bent back to form outward-facing hooks, respectively 41 and 51.

At the ends of their flat bases, the sections 25 and 26 present two ribs with inward-facing hooks 38.

Said boxes 40 and 50 can therefore be snap-mounted respectively onto the sections 25 and 26, as illustrated in FIGS. 8 and 5.

In FIG. 8 the hooks 51 on box 50 are about to be fitted together with the hooks 38 on section 26.

In FIG. 5 the hooks 41 on box 40 have been fitted into the hooks 38 on section 25.

The above boxes 40 and 50 respectively present light-shading tabs 43 and 53; similarly the sections 27 present light-shading tabs 36. The pleated blind 180 is fitted onto the upper fixed box 40 (FIG. 5) by insertion of its upper end 182 into the opposing grooves 46 formed by ribs 45, and onto the movable box 50 (FIG. 6) by insertion of its lower end 183 into the opposing grooves 66 formed by ribs 65.

Figures 3, 4:
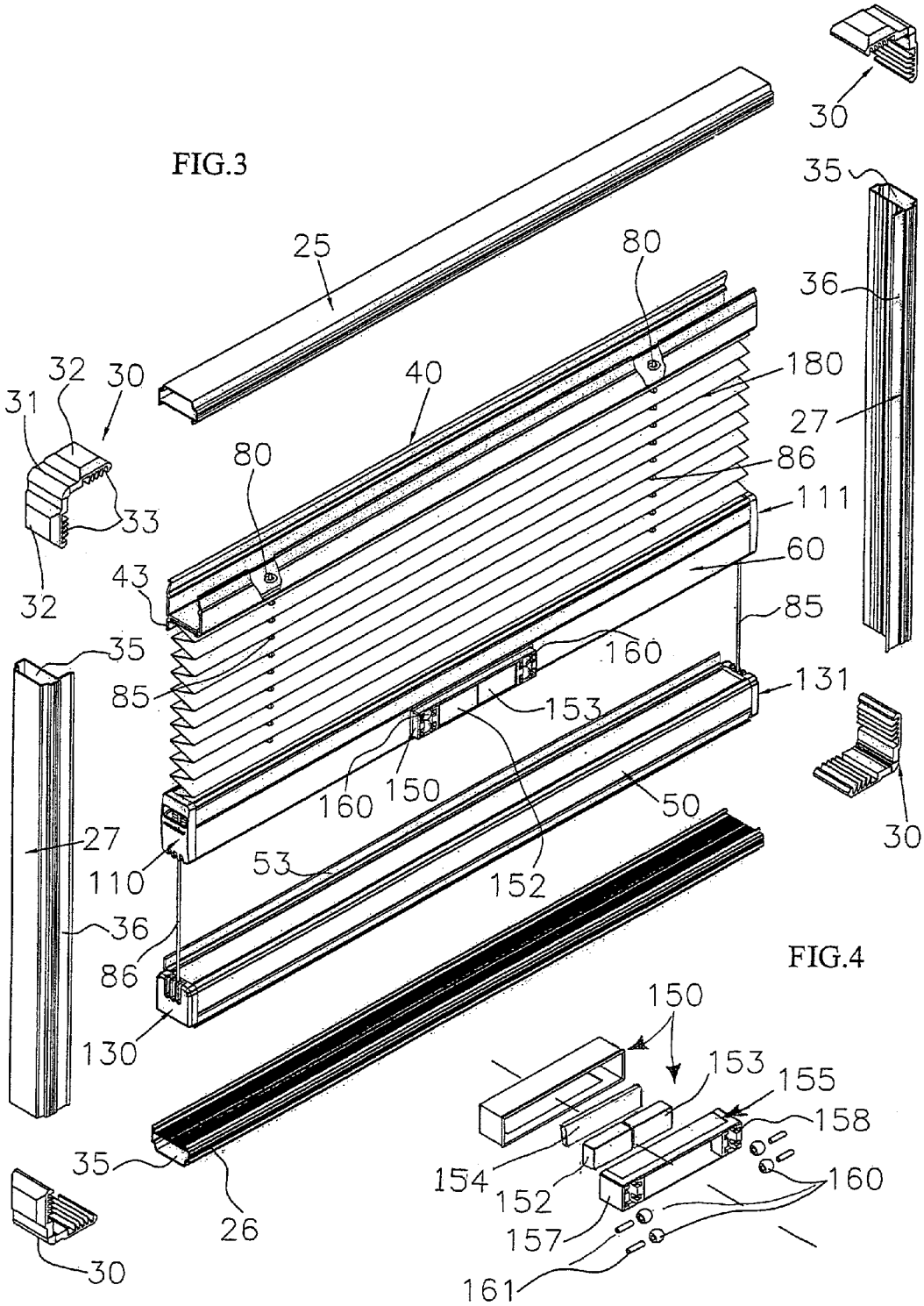
FIG. 3 The structure in FIG. 1, exploded perspective.
FIG. 4 The small magnetic box, exploded perspective.
Figure 9:
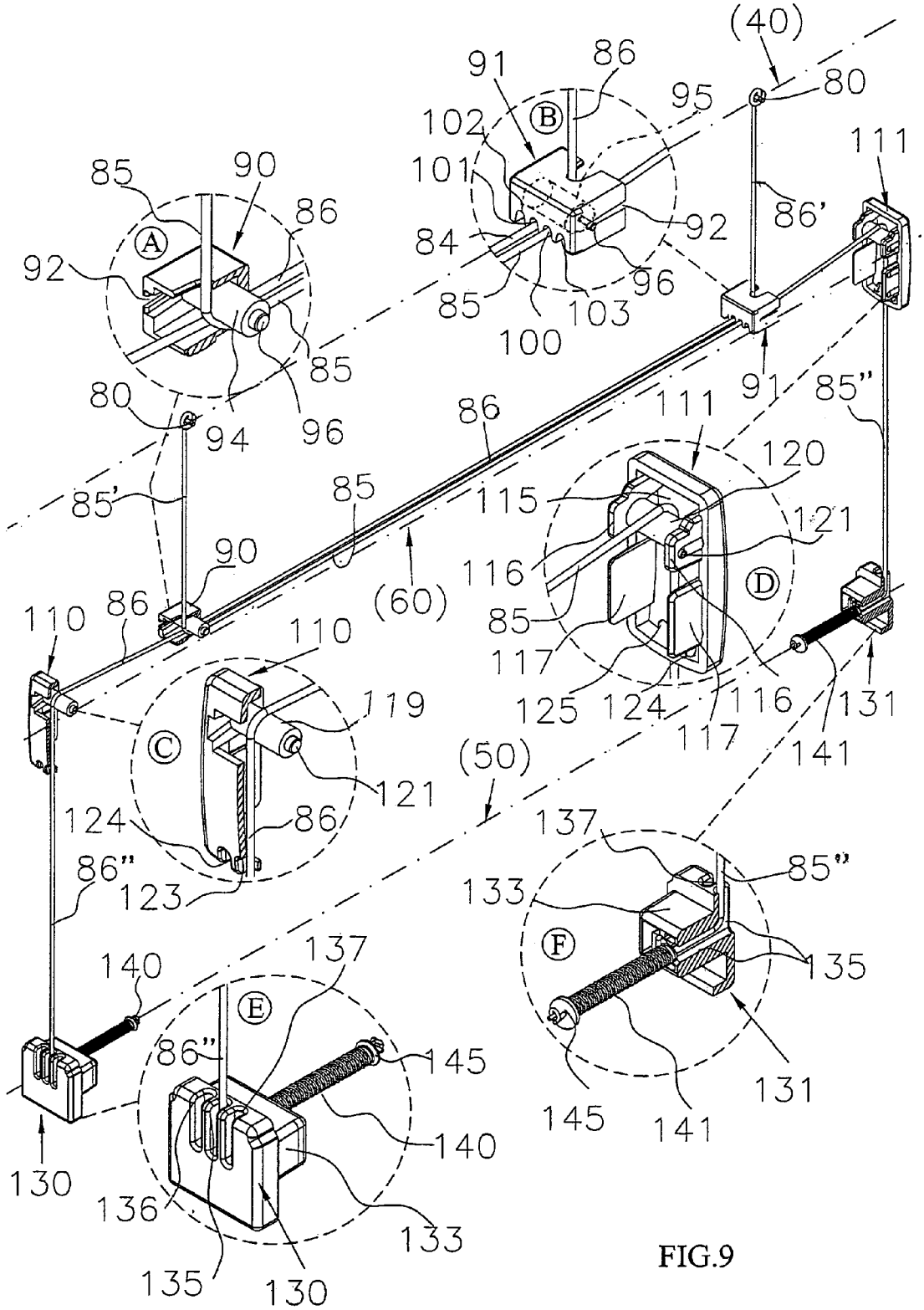
FIG. 9 Diagram showing the double-cord blind-guiding system served by compensating springs with details (A–F) of the heads for guiding and holding the two cords, perspective.

The movable box 60 (FIG. 6) is hung onto the upper fixed box 40 guided by the lower fixed blind-guiding box 50, by means of a guiding device consisting of cords 85 and 86 (FIGS. 1, 3 and 9).

The upper ends of said cords 85 and 86 are fixed to the upper box 40 by knots 80 or other equivalent means.

The lower ends of said cords are fixed to helical springs 140 and 141 supported by heads 130, 131 respectively inserted into the two ends of the lower fixed blind-guiding box 50, and can slide inside cornerwise channels 135, as seen in FIG. 9, marked E and F.

In FIG. 9 the upper 40, lower 50 and moveable 60 boxes are shown diagrammatically by axis lines (40), (50), (60).

The heads 130 and 131 are inserted at the end of the box 50 by extensions 133 shaped according to the upper part 58 of said box 50 marked off by the ribs 59 (FIG. 8).

The cords 85 and 86 are guided inside the movable box 60 by rollers 94 and 95 with pins 96 in the internal heads 90, 91, and by rollers 119 and 120 with pins 121 in the terminal heads 110 and 111 ( see FIG. 9, details A–D).

The internal heads 90, 91 are inserted in the channel 70 (FIG. 6) created in the movable box 60 by the diaphragm 68.

The terminal heads 110 and 111 are mounted at the ends of said movable box 60 by insertion of the two pairs of tabs 116 and 117 (FIG. 9, detail D) inside the ends of channels 70 and 71 respectively, created by the above diaphragm 68 (FIG. 6).

The cords 85 and 86 slide inside their respective grooves 100 and 101 in the internal heads 90 and 91.

The cords 85 and 86 slide inside the grooves 123 in the terminal heads 110 and 111.

The springs 140 and 141 automatically compensate any variations in length of the cords 85, 86 caused by thermal and mechanical stresses.

The small magnetic box 150 (FIG. 4) and the knob 170 (FIGS. 1 and 2) together create a device for moving the box 60 to open and close the blind 180.

This magnetic box 150 comprises a cage 155 with blocks 157 at its ends, for housing the two permanent magnets 152 and 153 placed side by side and held in position by an internal metal plate 154.

Said blocks 157 hold the four rollers 160 with rounded surfaces that freely turn on pins 161 in their slots 158.

Said rollers 160 project slightly outward from the permanent magnets 152, 153 which in turn project from the front of the box 60.

Figure 2:
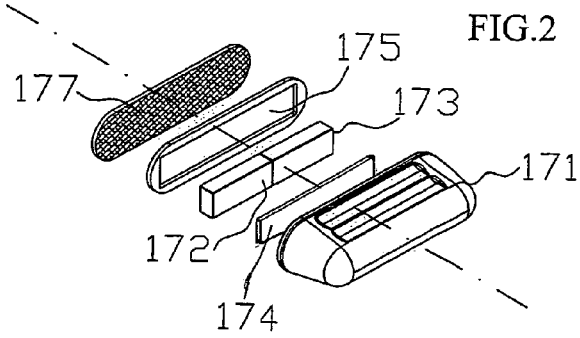
FIG. 2 Exploded view of the knob.

The knob 170 presents a concave body 171 for housing the permanent magnets 172, 173 set side by side and held in place by an internal metal plate and by the ring 175 (FIGS. 1 and 2).

A thin layer 177 of teflon, or some other slippery material, is laid on the outer face of said permanent magnets.

With the parts placed as described above, on moving the knob 170 on the glass pane 18 to the position of the small magnetic box 150, the pole of the permanent magnets 172, 173 being the opposite to that of the permanent magnets 152, 153 in said magnetic box, magnetic connection will be determined between the blind 180 and the knob 170.

The rollers 160 in the small magnetic box 150 rest on the glass pane 18 faciliating movement of the box 60 at the lower end of the blind 180 in order to open or close said blind.

As will be clearly seen in FIG. 9, the cord 85, fixed close to a first end of the fixed box 40, extends orthogonally passing through the blind 180 as far as the movable box 60, from there it passes below the roller 94 on the internal head 90 placed close to the first end of said box 60, extends as far as the second end of this latter and, passing over the roller 120 on the terminal head 111, extends orthogonally as far as the second end of the fixed box 50 till, crossing the channel 135 in the terminal head 131, it becomes attached to the spring 141.

The cord 86, fixed close to the second end of the fixed box 40, extends orthogonally through the blind 180 as far as the movable box 60, from there it passes under the roller 95 in the internal head 91 placed close to the second end of said box 60, extends as far as the first end of this latter and, passing over the roller 119 in the terminal head 110, extends orthogonally as far as the first end of the fixed box 50 where it is attached to the spring 140 mounted on the terminal head 130.

While determining, by means of the knob 170, movement of the box 60 for opening or closing the blind 180, this at the same time causes a variation in the length of the initial sections of cords 85' and 86', and a variation, equal and contrary, in the length of the end sections 85" and 86" of the cords 85 and 86.

It follows that any movement of said movable box 60, in guiding the pair of said cords 85 and 86, is made parallel to itself.

Figure 10:
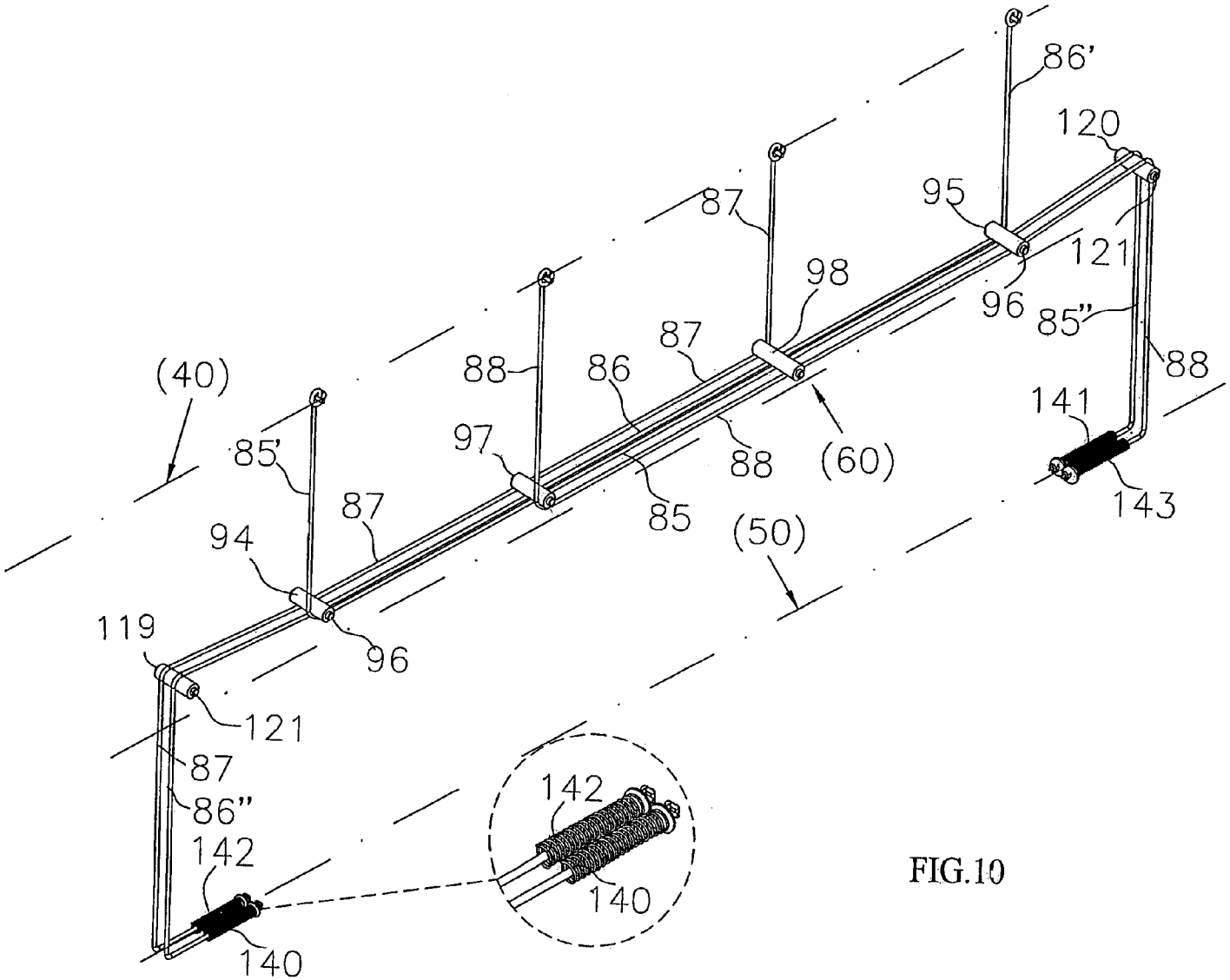
FIG. 10 Diagram of an altrnative four-cord blind-guiding system, perspective.

In the case of a very wide blind, four cords (FIG. 10) are used to support and guide it, done by adding to those 85 and 86 already mentioned, cords 87 and 88 respectively connected to springs 142 and 143 as seen in FIG. 10.

To make cords 87, 88 slide, a second pair of internal heads with rollers 97 and 98 are used.

As a consequence, in the terminal heads 110 and 11 on the movable box 60, cords 85, 86 are transferred to the lateral grooves 124 while cords 87 and 88 slide in lateral grooves 125 (FIG. 9, details C D) In the terminal heads 130, 131 of the lower box 50, cords 85, 86 are transferred to the lateral grooves 137 while cords 87, 88 are made to slide in lateral grooves 136 (FIG. 9, details E, F).

The second pair of cords 87,88 obviously function in the same way as the first pair 85,86.

The invention claimed is:

1. A system for operating a blind in a glass-enclosed chamber, comprising two panes of glass, and a frame having an upper section, a lower section and two lateral sections joined together by four corner pieces, the system comprising an upper fixed box which is fixed to the upper section of the frame and holds one end of the blind; a movable box which holds another end of the blind and is elongated; a pulling device extending through a pane and operating said movable box; and a guiding device for translating said movable box parallel to a direction of elongation of said movable box when the blind is being opened or closed, wherein said device for pulling said movable box includes a first means and a second means for generating reciprocal magnetic attraction, said first means being fixed to said movable box, said second means having a free knob so that, through one pane of the glass-enclosed chamber, said knob cooperates with said first means fixed to said movable box to open or close the blind, wherein said first means fixed to said movable box include a parallelepiped box inserted in a center of said movable box, a small box housing, a cage, permanent magnets placed side-by-side between two sets of free rollers, longitudinal pins passing through an external surface of said permanent magnets and from a front of said box to assist said first means to slide over a glass pane.

2. A system as defined in claim 1 wherein said rollers include two parallel rollers for each set with a surface being arched to make a brief contact with the pane.

3. A system as defined in claim 1, wherein said knob of said second means is substantially parallelepiped-shaped and houses further permanent magnets side-by-side with poles being opposite to poles of said permanent magnets, and also covered by a thin layer to assist said further permanent magnets to slide over the glass pane.

4. A system as defined in claim 3; and further comprising metal plates fitted to a bottom of a box of said first means and of said knob to hold said permanent magnets and said further permanent magnet in position.

5. A system as defined in claim 1 wherein said sections of said frame are tubular and have cross-cuts which are constant and have a flat side toward an inside of said frame, said corner pieces having two ends which have heads with elastically-toothed extensions for pressing inside ends of said tubular sections.

6. A system as defined in claim 1, wherein said movable box has a constant substantially square U-shaped cross-cut with a crosswise diaphragm forming an internal chamber and squared U-shaped open channel.

7. A system as defined in claim 1, wherein said lateral sections of said frame have light-shading tabs on an edge of flat sides facing toward an inside of the class-enclosed chamber.

8. A system as defined in claim 1, wherein the system is configured for operating the blind that is pleated.

9. A system for operating a blind in a glass-enclosed chamber, comprising two panes of glass, and a frame having an upper section, a lower section and two lateral sections joined together by four corner pieces, the system comprising an upper fixed box which is fixed to the upper section of the frame and holds one end of the blind; a movable box which holds another end of the blind and is elongated; a pulling device extending through a pane and operating said movable box; and a guiding device for translating said movable box parallel to a direction of elongation of said movable box when the blind is being opened or closed, wherein said guide device includes a pair of interacting cords including a first cord which is fixed close to a first end of said upper fixed box, then extends passing through pleats of the blind to said movable box, then passes around a first internal crosswise roller, then turns close to a first end of said movable box, then extends to a second end of said movable box, then passes around a second crosswise terminal roller, and then is fixed to a second end of a lower box fixed to said lower section of said fame, and a second cord which is fixed to a second end of said fixed box, then extends through the pleats of the blind to said movable box, then passes around a third internal crosswise roller and turns close to the second end of the movable box, then extends to the first end of said movable box, then passes around a fourth terminal crosswise roller and then is fixed to the first end of said lower fixed box, so that movement of said movable box to open or close the blind determines a variation in a length of first and second sections of said cords that connect said movable box to said upper fixed box, and a variation in length of second sections of said cords that connect said movable box to said lower fixed box, with movement of said movable box being therefore made parallel to a direction of elongation of said movable box.

10. A system as defined in claim 9, wherein a second pair of cords are connected to said fixed box and have sections that join said second pair of cords to said movable box so as to be in an intermediate position in relation to sections of said cords of said pair of interacting cords guided by other intermediate rollers, and sections of said second pair of cords that connect them to said lower box being guided by said second and fourth crosswise terminal rollers at ends of said movable box that guide said first pair of cords.

11. A system as defined in claim 9; and further comprising elastic parts which fix ends of said cords to one end and to the other end of said lower box and compensate variations in length of said cords resulting from thermal and mechanical stresses.

12. A system as defined in claim 11, wherein said elastic parts are helical springs arranged so that an end of each cord passes through said springs and is fixed to free ends of said springs.

13. A system as defined in claim 12; and further comprising heads with extensions that are fitted into two ends of said lower box where channels for passage of said cords are provided, said helical springs being applied to said heads.

14. A system as defined in claim 9, wherein said upper fixed box and a lower box have a constant U-shaped cross-section with a flat side facing forwards upper and lower sections of said frame, with ends of sides of said "U" having hook-shaped bends facing in opposite directions, and said upper and lower sections of said frame having hooks facing one toward the other and having a size and position that permit said fixed upper and lower boxes to fit into said sections of said frame by pressing said hooks on said an upper and lower fixed boxes into said hooks on said upper and lower sections of said frame.

15. A system as defined in claim 9, wherein said upper fixed box and said lower fixed box have light-shading tabs on an edge facing an outside of the glass-enclosed chamber.

16. A system as defined in claim 9, wherein said internal rollers around which said guide cords pass are supported by internal heads with grooves in which said guide cords pass, and said terminal rollers are supported by heads having grooves in which said cords pass, said internal heads being located in a longitudinal channel that is open toward said upper fixed box, in said movable box while said terminal heads are mounted at ends of said movable box by tongues inserted both in said longitudinal open channel and in an internal channel.

17. A system as defined in claim 8, wherein said upper fixed box on its side facing toward the blind has a pair of ribs that define a pair of opposing channels, and at ends of said open channel said movable box has a pair of ribs that define a pair of opposing channels so that the blind which is pleated is mountable by inserting its ends respectively in said pairs of said opposing channel.

* * * * *